US009557679B2

(12) United States Patent
Yamazaki

(10) Patent No.: US 9,557,679 B2
(45) Date of Patent: Jan. 31, 2017

(54) IMAGE FORMING APPARATUS EMPLOYING OPTICAL SCANNING APPARATUS THAT SCANS USING MULTIPLE BEAMS OF LIGHT EMITTED FROM MULTIPLE LIGHT SOURCES DRIVEN BY MULTIPLE DRIVING ICS

(71) Applicant: CANON KABUSHIKI KAISHA, Tokyo (JP)

(72) Inventor: Katsuyuki Yamazaki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 2 days.

(21) Appl. No.: 14/557,118

(22) Filed: Dec. 1, 2014

(65) Prior Publication Data

US 2015/0160582 A1 Jun. 11, 2015

(30) Foreign Application Priority Data

Dec. 11, 2013 (JP) ..... 2013-256443

(51) Int. Cl.
*G03G 15/04* (2006.01)
*G03G 15/043* (2006.01)

(52) U.S. Cl.
CPC ..... *G03G 15/043* (2013.01); *G03G 15/04072* (2013.01)

(58) Field of Classification Search
CPC ..... B41J 2/435; G03B 27/32; G03G 15/043; G03G 15/04072
See application file for complete search history.

(56) References Cited

U.S. PATENT DOCUMENTS

| | | | | |
|---|---|---|---|---|
| 7,450,145 | B2 | 11/2008 | Yamazaki | 347/261 |
| 8,823,762 | B2 | 9/2014 | Yamazaki | 347/236 |
| 2007/0285491 | A1 | 12/2007 | Kishimoto | 347/233 |
| 2011/0182603 | A1* | 7/2011 | Kawamoto | G03G 15/043 399/51 |
| 2013/0286132 | A1 | 10/2013 | Yamazaki | 347/118 |

FOREIGN PATENT DOCUMENTS

| | | | |
|---|---|---|---|
| JP | 2004021208 A | * | 1/2004 |
| JP | 2007-329429 | | 12/2007 |
| JP | 2011-173412 | | 9/2011 |

* cited by examiner

*Primary Examiner* — Sarah Al Hashimi
(74) *Attorney, Agent, or Firm* — Fitzpatrick Cella Harper & Scinto

(57) ABSTRACT

A light source array includes a first group of light sources having laser elements and a second group of light sources having laser elements. A first laser driver drives the laser elements and a second laser driver drives the laser elements. The first group of light sources and the second group of light sources execute multiple exposure. For example, the second group of light sources executes a first exposure and the first group of light sources executes a second exposure. In other words, the first group of light sources and the second group of light sources are driven by the first laser driver and the second laser driver, respectively, so as to expose the same position.

5 Claims, 14 Drawing Sheets

FIG. 8A

| IC \ SCAN NO. | 1 | 2 | 3 | 4 | 5 | 6 | 7 | TOTAL |
|---|---|---|---|---|---|---|---|---|
| FIRST LASER DRIVER | 0 | 36 | 37 | 29 | 31 | 27 | 14 | 164 |
| SECOND LASER DRIVER | 36 | 37 | 29 | 31 | 27 | 14 | 0 | 164 |

FIG. 8B

| IC \ SCAN NO. | 1 | 2 | 3 | 4 | 5 | 6 | 7 | TOTAL |
|---|---|---|---|---|---|---|---|---|
| FIRST LASER DRIVER | 24 | 36 | 32 | 36 | 32 | 30 | 14 | 204 |
| SECOND LASER DRIVER | 12 | 27 | 24 | 24 | 26 | 11 | 0 | 124 |

IMAGE FORMING APPARATUS EMPLOYING OPTICAL SCANNING APPARATUS THAT SCANS USING MULTIPLE BEAMS OF LIGHT EMITTED FROM MULTIPLE LIGHT SOURCES DRIVEN BY MULTIPLE DRIVING ICS

BACKGROUND OF THE INVENTION

Field of the Invention

The present invention relates to image forming apparatuses driven by optical scanning apparatuses that scan using multiple beams of light emitted from multiple light sources driven by multiple ICs.

Description of the Related Art

Japanese Patent Laid-Open No. 2011-173412 proposes an exposure apparatus (optical scanning apparatus) capable of simultaneously driving a total of eight lasers by using two laser control apparatuses (drivers) that are each capable of controlling four lasers. According to this optical scanning apparatus, eight primary scanning lines can be drawn simultaneously by the eight lasers, and thus the image forming apparatus can achieve higher speeds.

Meanwhile, a driver IC manufactured by integrating driving circuits can be used as a shared component in a high-speed printer, which uses the eight lasers, and a mid-speed printer, which uses four lasers. Using the same component among printers having different grades enables more of the same driver ICs to be manufactured, which leads to a reduction in costs.

However, even if multiple driver ICs that are identical components are used, scanning unevenness (exposure unevenness) can arise due to increases and decreases in the temperatures of the respective driver ICs. In other words, if the driver ICs used to form multiple primary scanning lines arranged in a secondary scanning direction (a rotation direction of the photosensitive member) are different, the exposure amounts of the primary scanning lines will vary depending on the driver ICs that are used. Specifically, different image data supplied to the multiple driver ICs, and the total level of current output for driving the lasers will also differ, resulting in different amounts of heat being produced by the respective driver ICs. In image forming apparatuses provided with optical scanning apparatuses, exposure unevenness leads to unevenness in the darkness, and this phenomenon can be particularly marked in images where there is a combination of horizontal stripes and halftones.

Japanese Patent Laid-Open No. 2007-329429 does disclose finding a driving current that achieves a constant light emission amount, taking into consideration the influence of temperature among multiple light-emitting elements provided in a surface emitting laser. However, Japanese Patent Laid-Open No. 2007-329429 does not focus on differences in amounts of heat produced among multiple driving ICs.

SUMMARY OF THE INVENTION

The present invention reduces scanning unevenness on a photosensitive member in an optical scanning apparatus that scans the photosensitive member using a semiconductor laser having a plurality of light sources.

The present invention provides an image forming apparatus comprising a photosensitive member, an optical scanning apparatus and a developing unit. The optical scanning apparatus may include the following elements. A semiconductor laser has a plurality of light sources that emit laser beams for forming an electrostatic latent image on the photosensitive member. A first driving IC drives a first group of light sources among the plurality of light sources in the semiconductor laser. A second driving IC drives a second group of light sources among the plurality of light sources in the semiconductor laser. A deflecting unit deflects a plurality of the laser beams so that the laser beams emitted from the plurality of light sources scan the photosensitive member. The optical scanning apparatus may form the electrostatic latent image on the photosensitive member by scanning the photosensitive member with the laser beams emitted from the first group of light sources by the first driving IC and scanning the photosensitive member with the laser beams emitted from the second group of light sources by the second driving IC. The developing unit may develop the electrostatic latent image formed on the photosensitive member using toner.

Further features of the present invention will become apparent from the following description of exemplary embodiments (with reference to the attached drawings).

BRIEF DESCRIPTION OF THE DRAWINGS

FIGS. 8A and 8B are diagrams illustrating examples of cumulative numbers of pixels on a driving IC-by-driving IC basis.

DESCRIPTION OF THE EMBODIMENTS

Overall Apparatus

Figure 1:
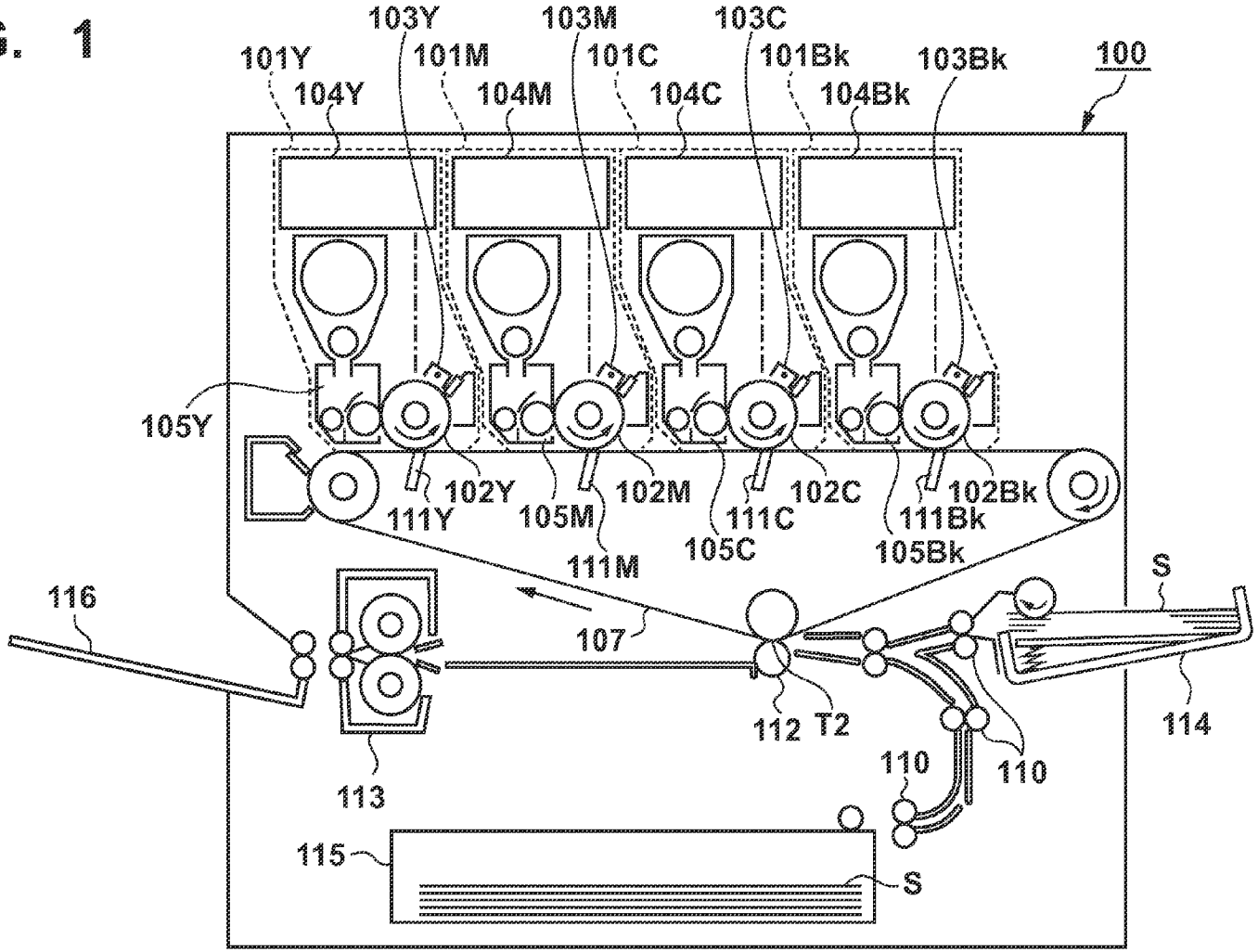
FIG. 1 is a diagram illustrating an example of an image forming apparatus.

An example of an image forming apparatus will be described using FIG. 1. An image forming apparatus 100 is a full-color printer that forms images using multiple toners having different colors. Although the following describes a full-color printer as an example of the image forming apparatus, it should be noted that the image forming apparatus 100 may be, for example, a black-and-white printer that forms images using a single color of toner (black, for example).

Image forming sections (image forming units) 101Y, 101M, 101C, and 101Bk are stations that form images using yellow (Y), magenta (M), cyan (C), and black (Bk) toners, respectively. Y, M, C, and Bk appended to reference numerals indicate the colors of the toner, but the Y, M, C, and Bk will be omitted from items that are the same for all of the four colors.

A charging device 103 uniformly charges the surface (an image forming surface) of a photosensitive drum 102, which serves as a photosensitive member. An optical scanning apparatus 104 forms an electrostatic latent image on the photosensitive drum 102 by scanning the photosensitive drum 102 with a laser beam pulsewidth-modulated according to image data. A developing device 105 forms a toner image by developing the electrostatic latent image on the photosensitive drum 102 using toner.

A primary transfer device 111 carries out the initial transfer of the toner image borne on the photosensitive drum 102 onto an intermediate transfer belt 107 by applying a transfer bias to the intermediate transfer belt 107. In other words, mutually different Y, M, C, and Bk toner images are superimposed on the intermediate transfer belt 107. A color toner image is formed on the intermediate transfer belt 107 as a result.

When a sheet S is fed from a manual sheet feed cassette 114, a sheet feed cassette 115, or the like, transport rollers 110 transport the sheet S toward a secondary transfer location T2. A secondary transfer device 112 carries out the secondary transfer of the color toner image on the intermediate transfer belt 107 onto the sheet S. A fixing device 113 thermally fixes the color toner image onto the sheet S. The sheet S is then discharged to a sheet discharge portion 116.

Beam Spots

Figure 2:
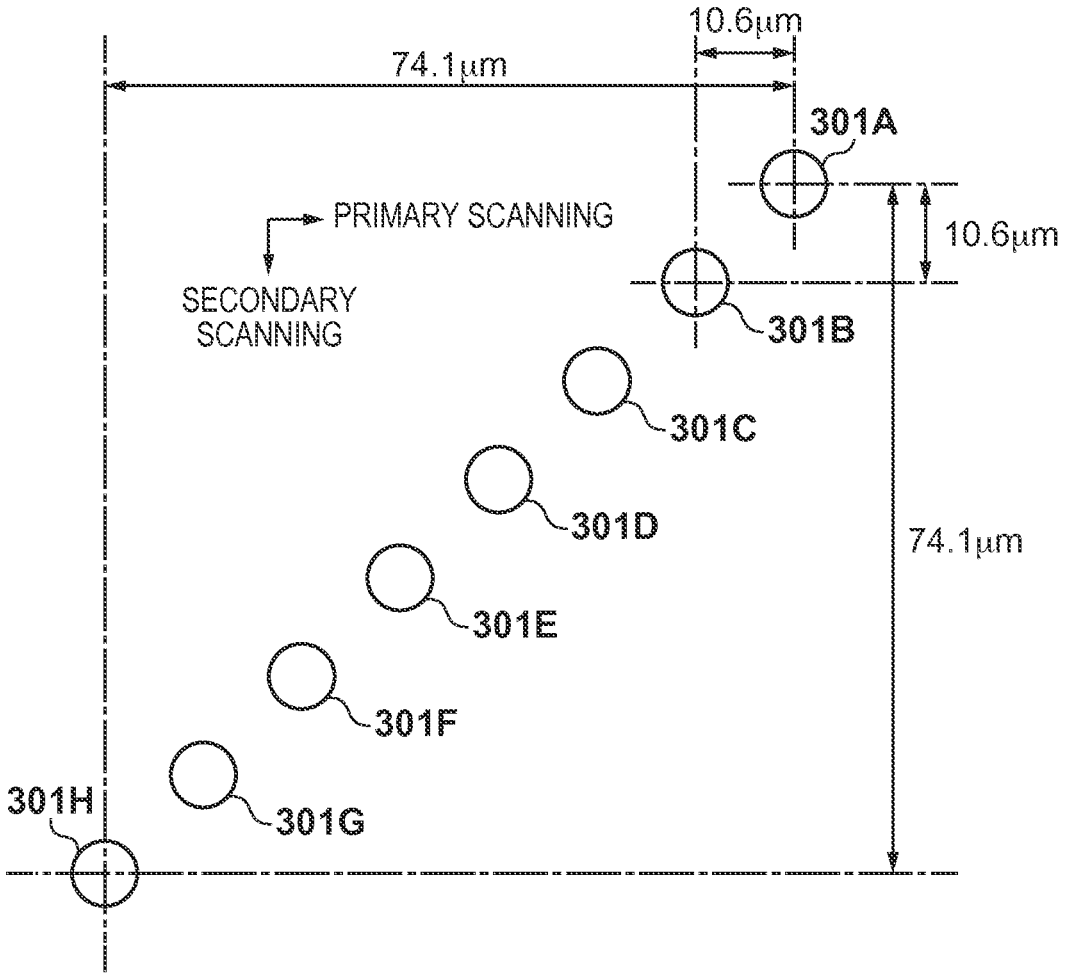
FIG. 2 is a diagram illustrating an arrangement of beam spots formed on a photosensitive drum.

FIG. 2 illustrates the arrangement of beam spots formed on the photosensitive drum 102 by laser beams output from semiconductor lasers that serve as a light source array provided in the optical scanning apparatus 104. The semiconductor laser may be a vertical-cavity surface-emitting laser, for example.

The light source array has eight laser elements arranged in a row. Eight beams of light output from the eight laser elements form eight respective beam spots 301A-301H on the photosensitive drum 102. As shown in FIG. 2, the eight beam spots 301A-301H are arranged in a row that is angled relative to the primary scanning direction by 45 degrees. The centers of two adjacent beam spots are separated by 10.6 μm, for example, in a primary scanning direction. Likewise, the centers of two adjacent beam spots are separated by 10.6 μm, for example, in a secondary scanning direction. Such an interval results in a resolution of 2,400 dpi (10.6 μm) in both the secondary scanning direction (the rotation direction of the photosensitive drum) and the primary scanning direction (the scanning direction of the laser beams). In other words, the beam spots 301A-301H are set based on the desired resolution. Note that a synchronization signal (a BD signal) for determining a write start position in the primary scanning direction, a write start position in the secondary scanning direction, and so on is generated by detecting the laser beam that forms the beam spot 301A. "BD" is an acronym for "beam detect".

Control Block Diagram

Figure 3:
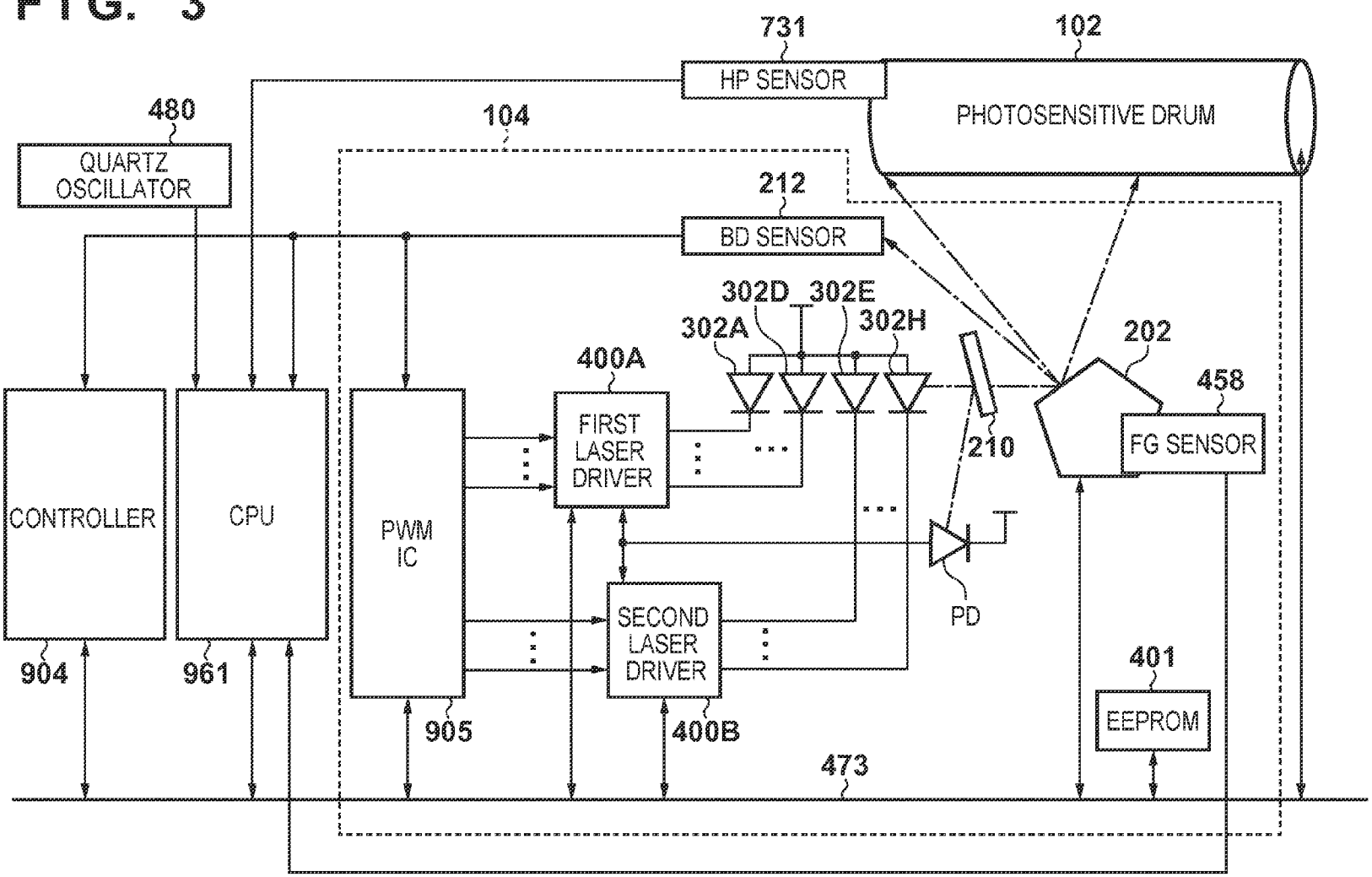
FIG. 3 is a diagram illustrating an example of a control system.

An example of a control system used in the image forming apparatus 100 will be described using FIG. 3. A CPU 961 is a control unit that controls eight laser elements 302A-302H via a PWM IC 905 that handles pulsewidth modulation, a first laser driver 400A, and a second laser driver 400B. Specifically, the CPU 961 functions as a supply unit that supplies the same image data to a first driving IC and a second driving IC so that the temperature of the first driving IC and the temperature of the second driving IC rise and fall in tandem. In FIG. 3, the first laser driver 400A and the second laser driver 400B correspond to the first driving IC and the second driving IC, respectively. "PWM IC" is an acronym for "pulsewidth modulation integrated circuit". The CPU 961 receives image data from a printer image controller (called simply a "controller 904" hereinafter).

The CPU 961 may be provided in the optical scanning apparatus 104 and mounted to a rear surface board of the image forming apparatus 100. The rear surface board is arranged in a position distanced from a board on which the laser elements 302A-302H are mounted. The CPU 961 communicates with the controller 904 and controls an image engine in correspondence therewith. The CPU 961 accepts the supply of an operating clock at 100 MHz, for example, from a quartz oscillator 480. The operating clock is used as an image clock in the laser scanning system.

The controller 904 separates RGB image data received from the exterior of the image forming apparatus 100 (a host computer, an image scanner, or the like, for example) into the four Y, M, C, and Bk colors, and converts the data into 256-tone bitmap data. Furthermore, the controller 904 converts the data into 2,400 dpi dual-tone bitmap data through a dithering process. The controller 904 then sends the bitmap data to a memory within the CPU 961. The CPU 961 transfers the bitmap data to the PWM IC 905 in synchronization with the BD signal output as a result of a BD sensor 212 receiving a laser beam from the laser element 302A. The PWM IC 905 pulsewidth-modulates the bitmap data on a pixel-by-pixel basis. The bitmap data is then converted into differential signals for the eight laser elements 302A-302H, and is sent to the first laser driver 400A and the second laser driver 400B.

Laser Drivers

The first laser driver 400A drives the laser elements 302A-302D, which serve as a first group of light sources, through PWM, in accordance with the differential signals. In other words, a driving current for driving the laser elements 302A-302D is pulse width modulated. The second laser driver 400B drives the laser elements 302E-302H, which serve as a second group of light sources, through PWM, in accordance with the differential signals. In other words, a driving current for driving the laser elements 302E-302H is pulse width modulated. A maximum light power of the laser beams from each of the laser elements is adjusted through automatic light power control (APC).

The first laser driver 400A and the second laser driver 400B may be four-beam multilaser drivers having the same component type number. For example, the first laser driver 400A and the second laser driver 400B may be 64-terminal QFP package (quadrangular surface-mounted) IC components. The four-beam multilaser driver can be shared in image forming apparatuses having a laser element in multiples of four, and is thus efficient from the standpoint of mass production. In other words, the IC components can be shared in high-quality printers provided with eight laser elements, 12 laser elements, or the like, and in mid-quality printers provided with four laser elements. The first laser driver 400A and the second laser driver 400B may be arranged so as to be distributed between a first surface side of the optical scanning apparatus 104 board and a second surface side, which is the reverse side from the first surface side. Meanwhile, the laser elements 302A-302D driven by the first laser driver 400A may be arranged near the first laser driver 400A on the first surface side of the board. Likewise, the laser elements 302E-302H driven by the second laser driver 400B may be arranged near the second laser driver 400B on the second surface side of the board. A DC 5 V line and a ground line are supplied to the first laser driver 400A and the second laser driver 400B from the rear surface board of the image forming apparatus 100. In other words, the two ICs and the eight laser elements may function under the supply of power from a shared power source.

The CPU 961 and the first laser driver 400A and second laser driver 400B are connected via a CPU bus 473. The CPU bus 473 may be shared by the first laser driver 400A and the second laser driver 400B. A light-receiving element PD used for the APC of the eight laser elements may also be shared between the first laser driver 400A and the second laser driver 400B. "PD" is an acronym for "photodetector". When the APC is carried out, the laser elements 302A-302H output laser beams exclusively at mutually different timings. The laser beams are partially reflected by a beam splitter 210 and are detected by the light-receiving element PD. As a result, a relationship between the light power and the driving current is determined by the CPU 961. A driving current required to achieve a target light power is determined based on this relationship. Meanwhile, the laser elements 302A-302H are adjusted by the CPU 961 so that the laser elements 302A-302H have the same maximum light power.

An HP sensor 731 outputs an HP signal each time the photosensitive drum 102 makes one rotation. "HP" is an acronym for "home position". An FG sensor 458 outputs an FG signal each time a specific surface of a rotating polygonal mirror driven by a motor 202 is detected. The FG signal may be used by the CPU 961 in order to monitor a rotational speed of the rotating polygonal mirror. Various types of data used by the CPU 961 in order to control the optical scanning apparatus 104 are stored in an EEPROM 401.

Control Flow

Figure 4:
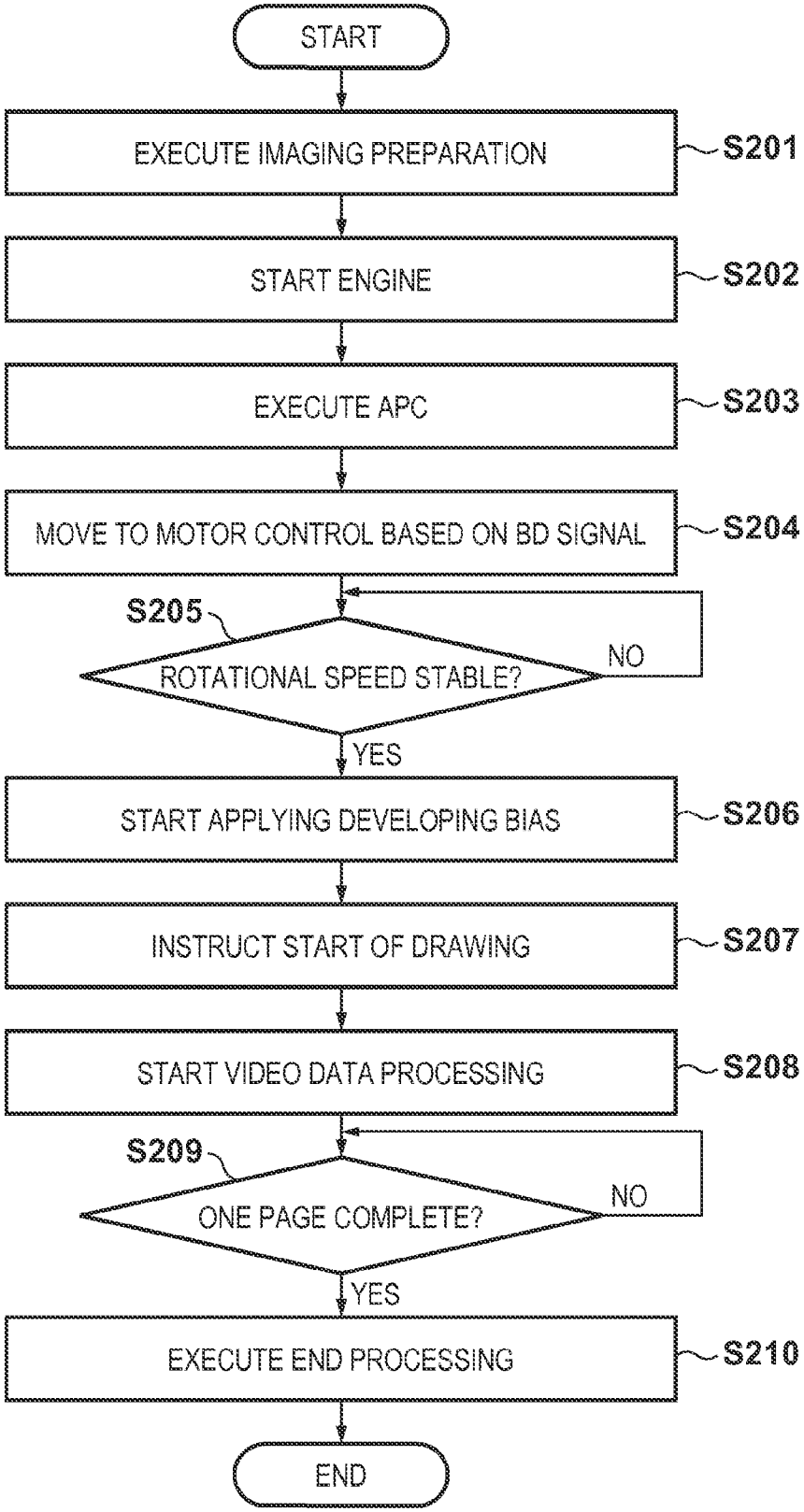
FIG. 4 is a flowchart illustrating an example of image forming control.

An example of image forming control executed by the CPU 961 will be described using FIG. 4. In S201, the CPU 961 carries out imaging preparation in accordance with an imaging preparation instruction input from the controller 904. For example, the CPU 961 instructs the controller 904 to prepare the bitmap data. Furthermore, the CPU 961 reads out control data to be used in image formation from the EEPROM 401, and writes that data into a memory provided within the CPU 961. The control data is, for example, tone table data for each pixel at 2,400 dpi. The CPU 961 reads out the tone table data from the memory and writes that data into a table register in the PWM IC 905.

In S202, the CPU 961 starts the image forming engine. For example, the CPU 961 instructs a driving unit in the photosensitive drum 102 to commence rotation. The driving unit, which is a motor, a motor driver, or the like, starts rotating the photosensitive drum 102 in response to the instruction. The HP sensor 731 generates the HP signal each time the photosensitive drum 102 makes one rotation and inputs the HP signal to the CPU 961. Meanwhile, the CPU 961 also carries out APC preparation. The CPU 961 sends an APC control instruction to the first laser driver 400A and the second laser driver 400B. The CPU 961 sets, in respective registers of the first laser driver 400A and the second laser driver 400B, the maximum light power (APC light power) to serve as a target for the optical scanning apparatus 104, based on the control data read out from the EEPROM 401. The maximum light power (driving current setting value) is assumed to be set in advance, when the optical scanning apparatus 104 is assembled at a factory or the like, by measuring the light power at the position of an irradiated surface of the BD sensor 212.

In S203, the CPU 961 executes the APC. For example, the CPU 961 starts driving the motor 202, which is a DC motor, through a motor driver IC provided within the motor 202. The FG sensor 458 provided in the motor 202 generates the FG signal (rotation position signal) each time a specific mirror surface among a plurality of reflective surfaces (five, for example) is detected, and inputs the generated signals to the CPU 961. The CPU 961 instructs the motor driver IC to carry out the rotation in response to the FG signal. Upon receiving the rotation instruction signal from the CPU 961, the motor driver IC keeps the rotational speed of the rotating polygonal mirror (a deflecting unit) at a predetermined rotational speed by carrying out feedback control of the motor 202. Note that the rotating polygonal mirror functions as a deflecting unit that deflects a plurality of laser beams emitted from a plurality of light sources so that the laser beams scan the surface of a photosensitive member.

Upon detecting that the rotational speed of the rotating polygonal mirror has reached the predetermined rotational speed based on the FG signal, the CPU 961 causes the lasers to emit light, and instructs the first laser driver 400A and the second laser driver 400B to commence the APC. The first laser driver 400A executes the APC in order for the laser elements 302A-302D that form the first group of light sources. The laser beams are received by the light-receiving element PD and the light power is found by the CPU 961.

First, the first laser driver 400A can detect the laser beam from the laser element 302A using the BD sensor 212, by controlling the light-emission power of the laser element 302A to a sufficient light-emission power. The BD signal is output to the CPU 961 by the BD sensor 212 as a result.

Thereafter, the CPU 961 moves to a sequence-based light-emission control state (cyclical APC), in which APC is carried out for all of the laser elements 302A-302H. In the cyclical APC, the APC is executed for the first laser element 302A with the first BD signal serving as a reference (a trigger). Then the APC is executed for the second laser element 302B with the second BD signal serving as a reference. The APC is then executed for the third laser element 302C to the seventh laser element 302G based on the third BD signal to the seventh BD signal, respectively. Finally, the APC is executed for the 8th laser element 302H with the 8th BD signal serving as a reference. APC control results are recorded into the registers of the first laser driver 400A and the second laser driver 400B. In this manner, the first laser driver 400A executes the APC in order for the laser elements 302A-302D that form the first group of light sources. Likewise, the second laser driver 400B executes the APC in order for the laser elements 302E-302H that form the second group of light sources.

In S204, the CPU 961 moves from motor control based on the FG signal to motor control based on the BD signal.

In S205, the CPU 961 determines, based on the BD signal, whether or not the rotational speed of the rotating polygonal mirror is being kept stable at a target rotational speed. For example, the CPU 961 may measure the time between one BD signal and the next BD signal and determine whether or not the measured time has reached a predetermined time. This is because the time from one BD signal to the next BD signal is proportional to the rotational speed of the rotating polygonal mirror. Once the rotational speed of the rotating polygonal mirror is stable, the process moves to S206.

In S206, the CPU 961 issues, to the developing device 105, permission to apply a developing bias as drawing start preparation.

In S207, the CPU 961 instructs the controller 904 to start drawing. In response to the drawing start instruction, the controller 904 starts outputting the bitmap data of a first surface.

In S208, the CPU 961 permits a BD interruption and starts video data processing. Details of the BD interruption and the video data processing will be given later.

In S209, the CPU 961 determines whether or not one page's worth of printing has ended. The process moves to S210 after waiting until one page's worth of printing has ended.

In S210, the CPU 961 executes and ending process. For example, the CPU 961 stops the motors, such as the motor 202, and extinguishes the laser elements 302A-302H. Furthermore, the CPU 961 masks the BD interruption and cancels the developing bias.

Video Data Processing

Next, a video data processing function realized by the CPU 961, the first laser driver 400A, and the second laser driver 400B will be described. The video data processing is carried out through the following seven steps:

(1) preparing image data in the memory within the CPU 961
(2) configuring a PWM tone table
(3) generating and inputting a reference position signal
(4) specifying an exposure position by measuring time using the reference position signal as a trigger
(5) reading out image data in a multiple exposure sequence
(6) multilaser write delay
(7) transferring data to PWM IC These seven steps will be described individually hereinafter.

(1) Preparing Image Data in the Memory

Figure 5:
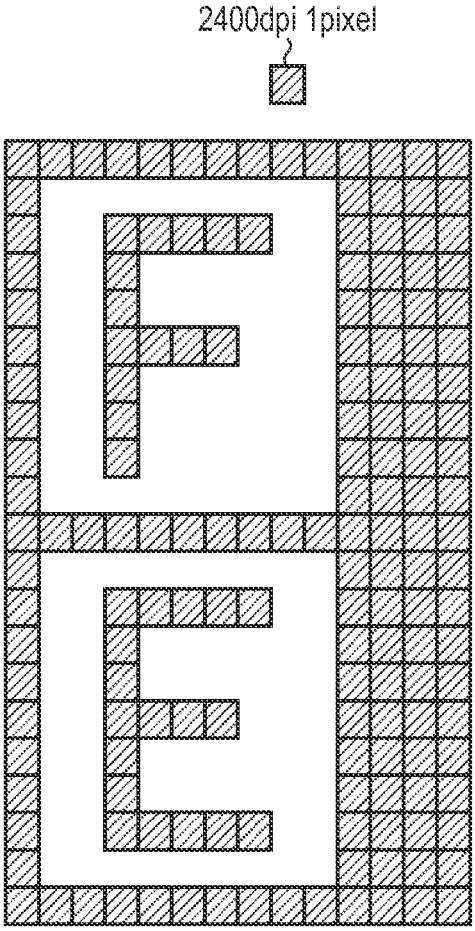
FIG. 5 is a diagram illustrating an example of an image.

This preparation operation is carried out in S202. The CPU 961 obtains one page's worth of image data (bitmap data) from the controller 904. FIG. 5 illustrates an example of the bitmap data. The resolution is 2,400 dpi, and the number of pixels is 14 pixels×21 pixels. The bitmap data is dual-tone image data. As such, each pixel is either a black pixel or a white pixel.

(2) Configuring a PWM Tone Table

In the PWM configuration executed in S201, the PWM IC 905 selects a 13-step tone table for each pixel in the 2,400 dpi data. A single pixel is divided into a maximum of 12 parts, for example, based on the relationship between the scanning speed and the resolution. PWM is used in order to dynamically reduce the maximum light power determined through the APC to the light power (exposure amount) at the surface of the photosensitive drum 102. In other words, the exposure amount is adjusted by increasing/decreasing a period (width) for which a driving current capable of producing the maximum light power flows.

Although the image shown in FIG. 5 includes text and line images, the image from the controller 904 is supplied to the CPU 961 after undergoing an area gradation process into two tones through dot screen processing. The exposure amount is not adjusted while the one page's worth of the image is being formed. In the case where the tones from black to white are expressed in ten levels, a black pixel is expressed as a ten-tone width (a maximum width in the PWM), whereas a white pixel is expressed as a zero-tone width (no light emission).

(3) Generating and Inputting a Reference Position Signal

The CPU 961 controls the rotation of the motor 202 at a constant speed, and carries out feedback control so that the BD signal is detected at a substantially constant cycle. The CPU 961 handles the BD signal as an interrupt signal and starts the video data processing.

Figure 6:
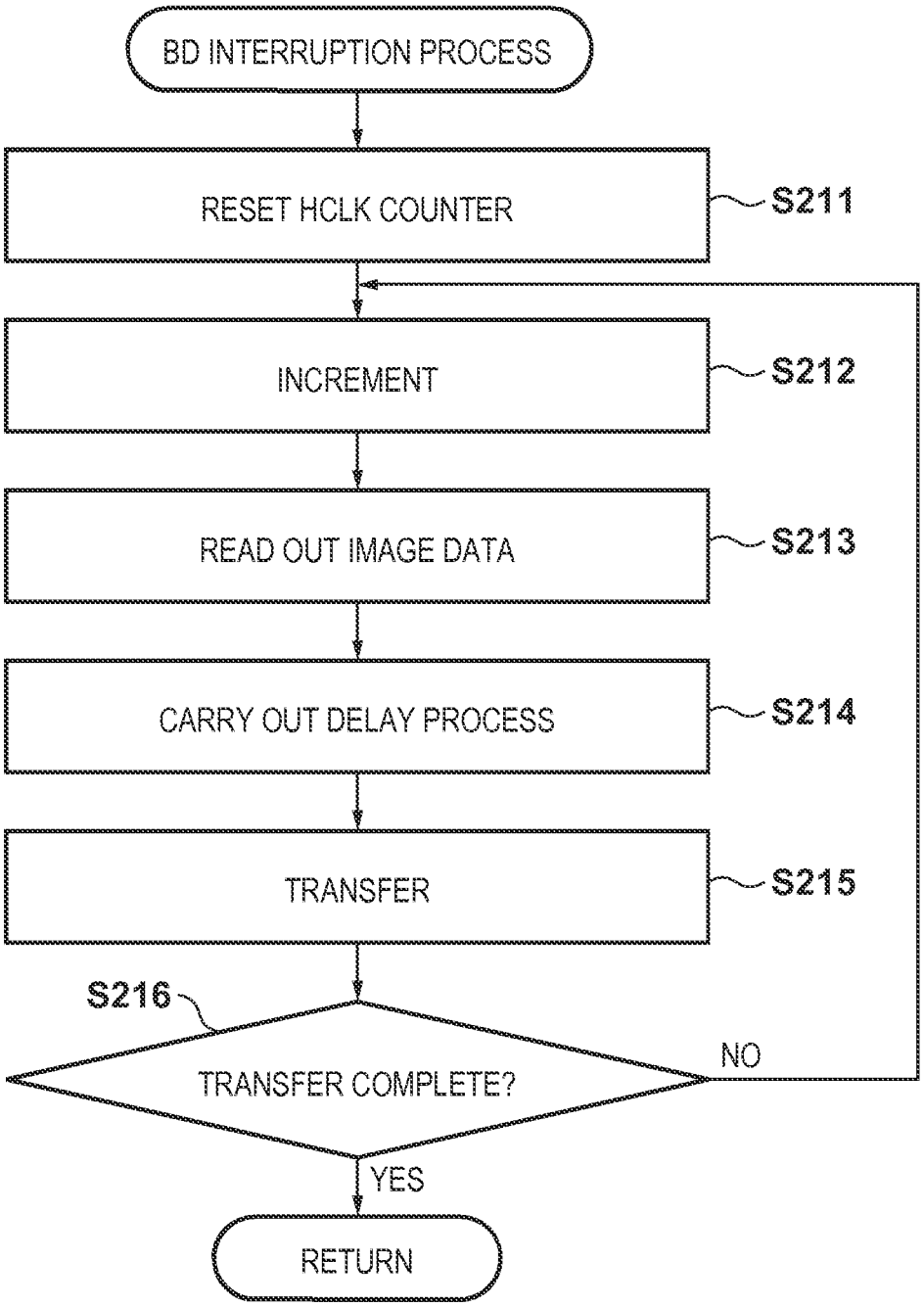
FIG. 6 is a flowchart illustrating an example of a BD interrupt process.

(4) Specifying an Exposure Position by Starting to Measure Time Using the Reference Position Signal as a Trigger An example of a BD interrupt process executed by the CPU 961 will be described using FIG. 6. The BD interrupt process is a process executed due to the BD signal. Upon receiving the BD signal from the BD sensor 212, the CPU 961 emits the interrupt based on the fall of the BD signal.

In S211, the CPU 961 resets a counter that counts a primary scanning position (an HCLK counter).

In S212, the CPU 961 increments the HCLK counter each time an image clock HCLK is input from the quartz oscillator 480. Based on an image data width for a single scan, the HCLK counter repeatedly increments from 0 to 32,767 with each scan. In this manner, the CPU 961 specifies the current primary scanning position using the HCLK counter.

(5) Reading Out Original Image Data in a Multiple Exposure Sequence

In S213, the CPU 961 reads out the original image data from the memory in accordance with the primary scanning position on the surface of the drum during a single scan. Each piece of pixel data in a single scan corresponds to the current primary scanning position specified by the HCLK counter. Eight pieces of pixel data corresponding to the eight laser elements 302A-302H are read out from the memory.

(6) Multilaser Write Delay

Figure 7:
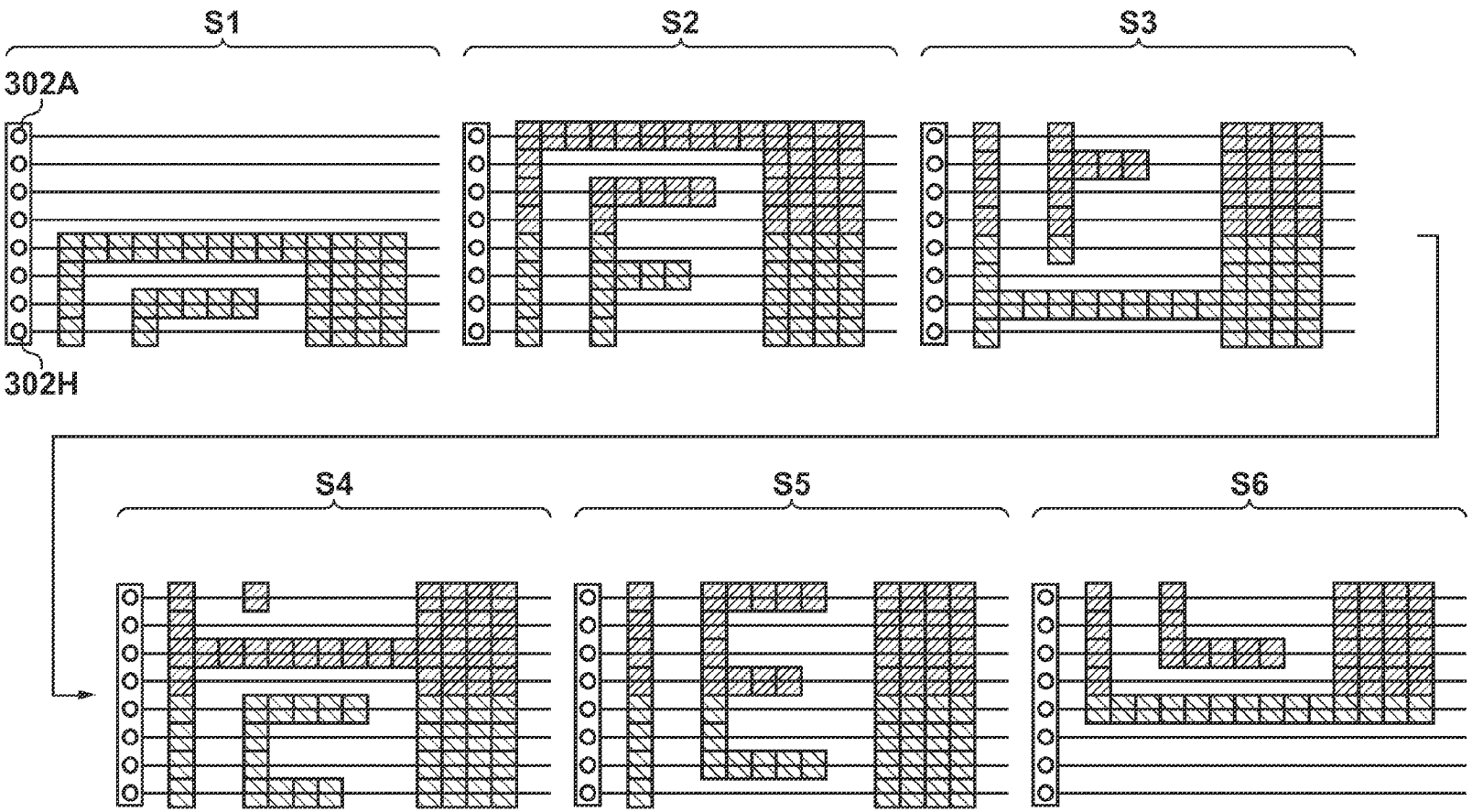
FIG. 7 is a diagram illustrating an example of multiple exposure.

In S214, the CPU 961 counts the image clock HCLK and carries out a delay process for each piece of image data. As described using FIG. 2, the eight laser elements 302A-302H are arranged so as to be angled relative to the primary scanning direction. Accordingly, it is necessary to delay the timing of primary scan writes based on the arrangement positions of the eight laser elements 302A-302H in order for the primary scanning positions of the eight laser elements 302A-302H to match. The arrangement positions of the eight laser elements 302A-302H are shifted by one pixel each in a 2,400 dpi resolution. Accordingly, the CPU 961 sets delay amounts of 0 to 7 in the laser elements 302A-302H, respectively. For example, the laser element 302H exposes the same region (primary scanning position) as the laser element 302A, delayed relative thereto from the BD signal by seven pixels. Accordingly, the laser element 302H supplies image data having been delayed from the laser element 302A by seven pixels. Note that the delay amount is set by converting the count value of the HCLK counter. As a result of this delay processing, the orthogonality of a two-dimensional pixel array can be reproduced on the surface of the photosensitive drum 102, as indicated in FIG. 7, even with a light source array in which a plurality of light sources are arranged at a 45-degree angle.

(7) Transferring Data to PWM IC

In S215, the CPU 961 transfers the image data to the PWM IC 905 via the CPU bus 473. 3-bit PWM video data is transferred to each laser element. In S216, the CPU 961 determines whether or not the transfer of all image data in a single BD cycle (a single primary scanning line) is complete. For example, the CPU 961 determines whether or not the count value of the HCLK counter has reached 32,767. The count value reaching 32,767 means that all of the image data for the single primary scanning line has been transferred, and thus the CPU 961 ends the BD interrupt process. However, the process returns to S212 if the count value is less than 32,767.

An example of the multiple exposure sequence will be described using FIG. 7. FIG. 7 schematically illustrates a correspondence relationship between a latent image on the surface of a drum and video data. In other words, a relationship between the laser elements 302A-302H and six scans S1-S6 corresponding to six BD signals is illustrated. Note that the video data is image data output to the PWM IC by the CPU 961.

In the first scan S1, four lines' worth (that is, four pixels each) of image data is read out from the memory and supplied to the laser elements 302E-302H serving as the second group of light sources. In other words, the image data is supplied to the second laser driver 400B through the PWM IC 905.

The pixels formed by the laser elements 302A-302D included in the first group of light sources driven by the first laser driver 400A are indicated as black pixels. The pixels formed by the laser elements 302E-302H included in the second group of light sources driven by the second laser driver 400B are indicated as gray pixels. The photosensitive drum 102 rotates by four lines in the secondary scanning direction from when one BD signal is output to when the next BD signal is output. Note that the laser elements 302A-302D and the laser elements 302E-302H are arranged so that the laser beams emitted from the laser elements 302E-302H scan the upstream side of the photosensitive member in the rotation direction, relative to the laser beams emitted from the laser elements 302A-302D.

In S2, the CPU 961 reads out eight lines' worth of image data from the memory and supplies the data to the first laser driver 400A and the second laser driver 400B through the PWM IC 905. In other words, the image data read out for the second group of light sources in S1 is read out again and supplied to the laser elements 302A-302D for the first group of light sources. The next new four lines' worth of image data in the secondary scanning direction is then supplied to the laser elements 302E-302H in the second group of light sources. Because the latter half of the four lines' worth of image data in S1 and the former half of the four lines' worth of image data in S2 are the same image data, multiple exposure (multiple scanning) is executed every four lines between the first group of light sources and the second group of light sources.

The process of S2 is repeated from S3 to S6. In other words, of the eight lines' worth of image data, the four lines' worth of image data supplied to the first group of light sources is the same as the four lines' worth of image data supplied to the second group of light sources in the previous BD cycle. As a result, multiple exposure is executed for all lines by the first group of light sources and the second group of light sources.

In this manner, the region exposed by the laser beams emitted from the laser elements 302E-302H in the second group of light sources in an nth scanning period moves from the upstream side to the downstream side in the rotation direction as a result of the photosensitive member rotating. That region is exposed by the laser beams emitted from the laser elements 302A-302D in the first group of light sources in an n+1th scanning period.

The original image data shown in FIG. 5 is made up of 164 pixels (328 pixels when counted in multiple). As shown in FIG. 8A, a cumulative pixel value of the first laser driver 400A and a cumulative pixel value of the second laser driver 400B are both 164 from the first scan to the seventh scan. In other words, the number of pixels whose exposure is handled by the first laser driver 400A matches the number of pixels whose exposure is handled by the second laser driver 400B. In this manner, the exposure process is distributed evenly between the first laser driver 400A and the second laser driver 400B.

Increase in Driver Temperature

Figure 9:
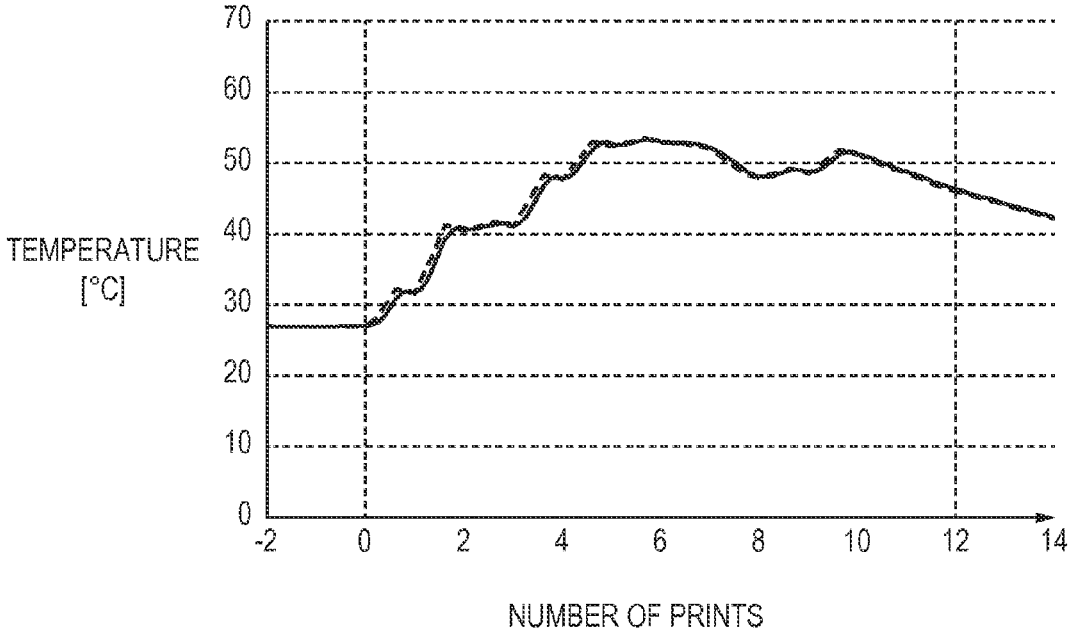
FIG. 9 is a diagram illustrating an example of temperature changes in a driving IC.

FIG. 9 illustrates the temperature of the first laser driver 400A and the temperature of the second laser driver 400B in the case where ten images are formed in succession. A solid line represents the temperature of the first laser driver 400A and a broken line represents the temperature of the second laser driver 400B. The horizontal axis represents the number of prints. The vertical axis represents the surface temperature of the IC chip. Here, images are formed in succession on 12 A4-size sheets S in 24 seconds.

The temperature of the first laser driver 400A and the temperature of the second laser driver 400B increase from 27° C., which is room temperature, to 55° C. It takes approximately 1 second to create an image on a single sheet S, and it also takes approximately 1 second between the following end of a sheet S and the leading end of the next sheet S (that is, a non-image creation time). In other words, heating and heat dissipation are repeated every second. As a result, the temperature changes in a sawtooth shape due to the 12 temperature increases. When the 12 prints are complete, the temperature of the first laser driver 400A and the temperature of the second laser driver 400B drop gradually to approximately 40° C.

In the present embodiment, the same image data is supplied to the first laser driver 400A, serving as the first driving IC, and the second laser driver 400B, serving as the second driving IC. Accordingly, the temperature of the first laser driver 400A and the temperature of the second laser driver 400B rise and fall in tandem. This is because the first laser driver 400A controls the first group of light sources and the second laser driver 400B controls the second group of light sources so that the first group of light sources and the second group of light sources expose the same pixels with the same image data. This is furthermore because multiple exposure is executed by the first group of light sources executing the first exposure and the second group of light sources executing the second exposure of the same position exposed by the first exposure. As shown in FIG. 9, the temperature of the first laser driver 400A and the temperature of the second laser driver 400B are only different by approximately an amount equivalent to measurement error, and the two temperatures are thus substantially the same.

Light Power Variations Due to Temperature Difference

In the APC realized by the first laser driver 400A, the second laser driver 400B, the light-receiving element PD, and the cyclical APC, control error of a maximum of approximately ±1% can occur if the temperature of each driver changes by 10° C. The light power will change by approximately 1% if the driving current changes approximately ±1%.

Figure 10:
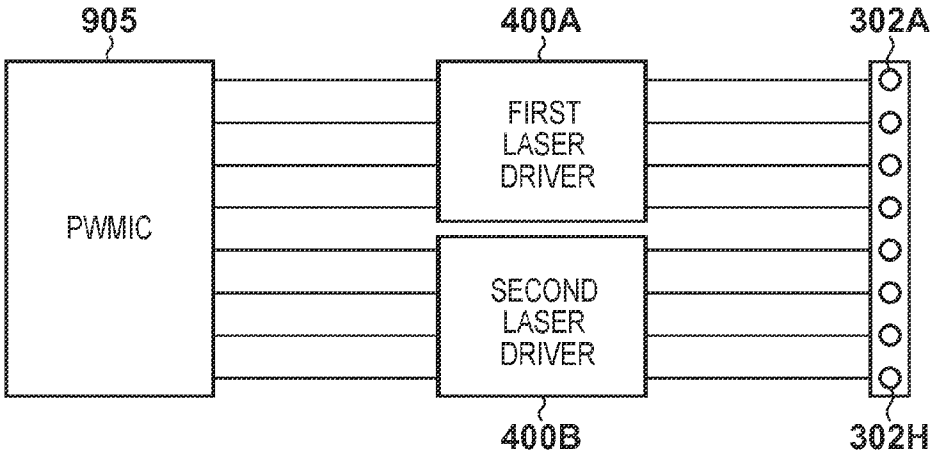
FIG. 10 is a diagram illustrating an example of connections between a driving IC and a light source array.

However, if the multiple exposure process is distributed evenly between the first laser driver 400A and the second laser driver 400B as shown in FIG. 10, the temperature difference between the first laser driver 400A and the second laser driver 400B will become extremely low (2.5° C. or less) at all times. Accordingly, variations in the light power resulting from changes in the temperatures between the laser drivers will be kept almost within 0.5%.

At the micro scale, as can be seen from the example shown in FIG. 7, there is a time difference equivalent to one BD cycle (approximately 1 millisecond) between the first exposure and the second exposure during the multiple exposure. In other words, the second laser driver 400B experiences a change in temperature before the first laser driver 400A by a time equivalent to that time difference. However, as can be seen in FIG. 9, this time difference is extremely low relative to the temperature change. In other words, the temperature difference caused by the time difference is no greater than 1° C.

Comparison Between Comparative Example and Embodiment

Figure 11:
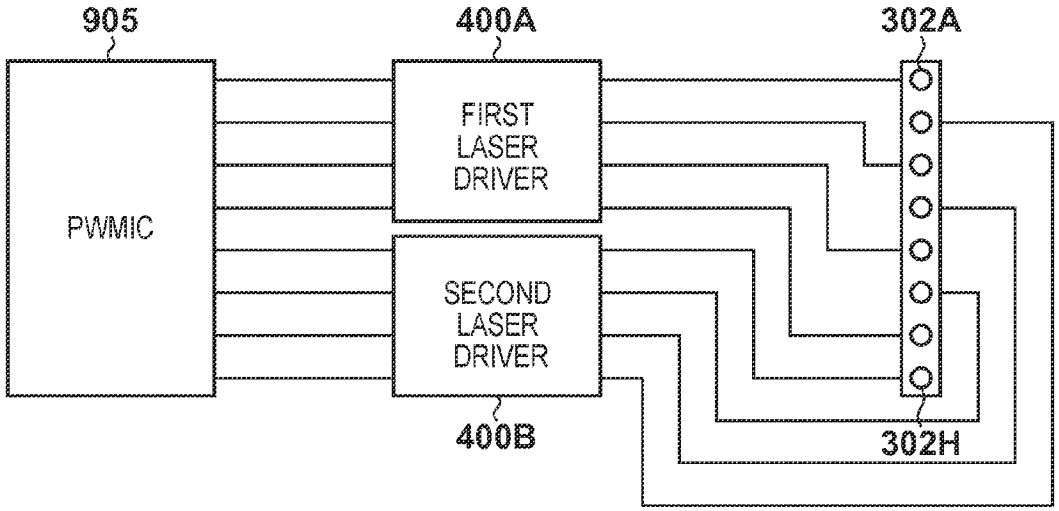
FIG. 11 is a diagram illustrating a comparative example.

FIG. 11 illustrates the configuration of a comparative example. The first laser driver 400A drives odd-numbered laser elements and the second laser driver 400B drives even-numbered laser elements. In other words, according to the comparative example, the multiple exposure process is not distributed evenly between the first laser driver 400A and the second laser driver 400B.

Figure 12:
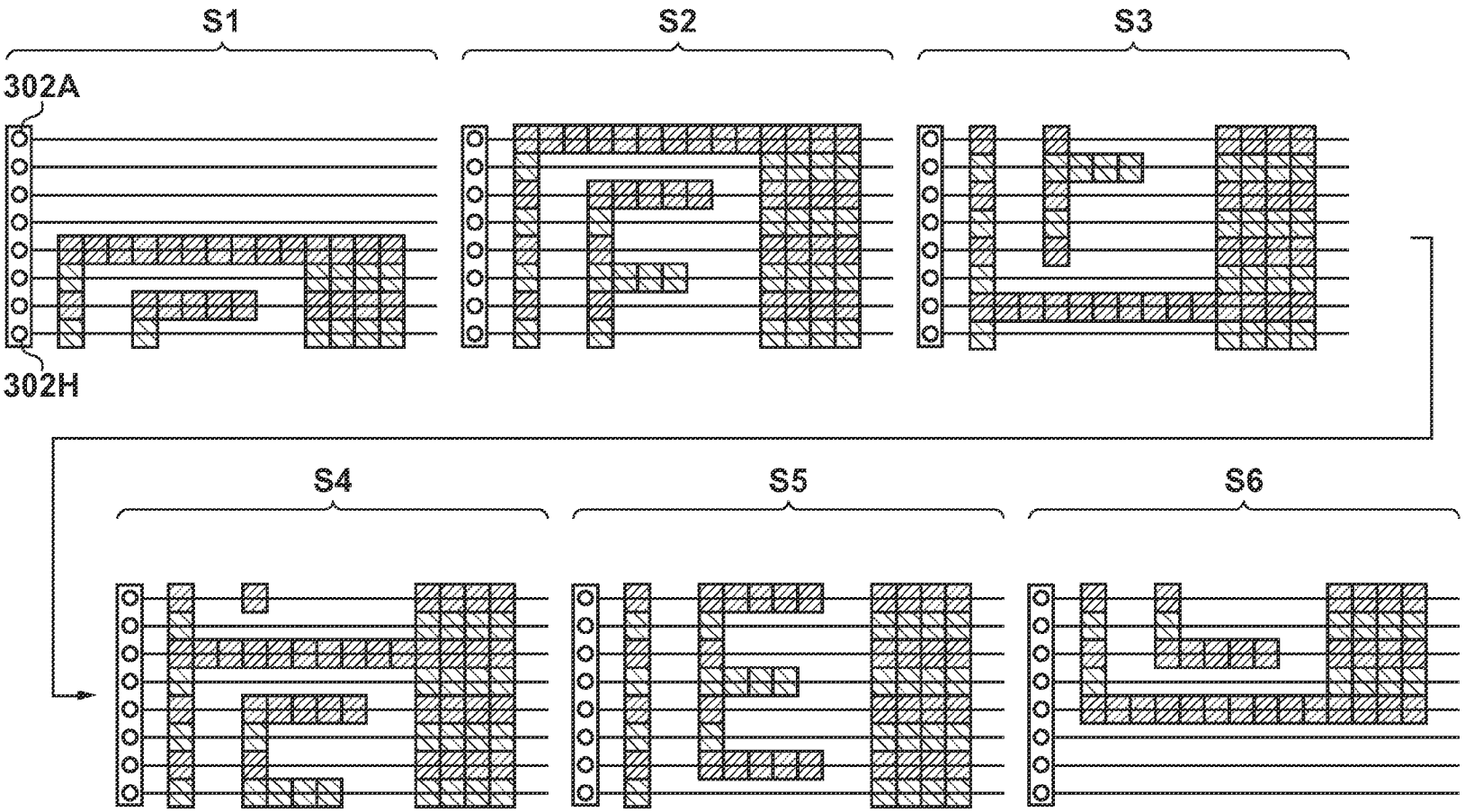
FIG. 12 is a diagram illustrating multiple exposure according to the comparative example.

FIG. 12 illustrates an example of exposure in the comparative example. Pixels whose exposures are handled by the first laser driver 400A are indicated as black pixels, whereas pixels whose exposures are handled by the second laser driver 400B are indicated as gray pixels. FIG. 8B illustrates the cumulative number of pixels processed by the first laser driver 400A and the cumulative number of pixels processed by the second laser driver 400B according to the comparative example. Here, seven scans have been executed. As can be seen by comparing this diagram to the cumulative number of pixels according to the embodiment as shown in FIG. 8A, the cumulative number of pixels processed by the first laser driver 400A and the cumulative number of pixels processed by the second laser driver 400B diverge significantly in the comparative example.

Figure 13:
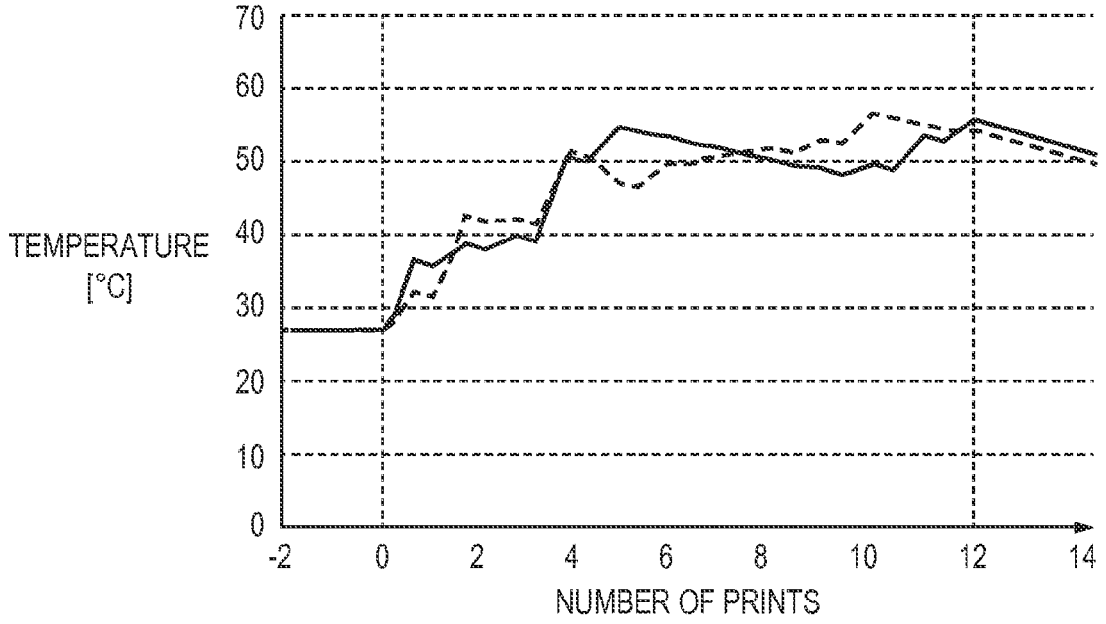
FIG. 13 is a diagram illustrating an example of temperature changes in a driving IC according to the comparative example.

FIG. 13 illustrates the temperature of the first laser driver 400A and the temperature of the second laser driver 400B relative to a number of images formed according to the comparative example. A solid line represents the temperature of the first laser driver 400A and a broken line represents the temperature of the second laser driver 400B. The horizontal axis represents the number of prints. The vertical axis represents the surface temperature of the IC chip. Here, images are formed in succession on 12 A4-size sheets S in 24 seconds. As shown in FIG. 13, a difference between the temperature of the first laser driver 400A and the temperature of the second laser driver 400B is a maximum of approximately 10° C. When the temperature difference becomes this high, the light power variation will increase to a maximum of ±2%. As a result, unevenness in the darkness will occur in the image and the image quality will degrade.

Algebra for generalizing the configuration of the present invention will be defined as follows. The number of light sources (laser elements) that configure a light source array is represented by N (where N is an integer of 4 or greater). A maximum number of laser elements that can be driven by a single laser driver (driving IC) is represented by L (where L is an integer of 2 or greater). A number of driving ICs that are mounted is represented by Q (where Q is an integer of 2 or greater). A number of times multiple exposure is carried out is represented by M. As such, in the present embodiment, N=8, L=4, Q=2, and M=2.

Here, N and (L×Q) being the same indicates that there are no additional laser elements that can be driven by the driving IC. In other words, the mounting efficiency of the driving ICs increases. Meanwhile, M being equal to Q and both values being 2 serves as an example of the most basic configuration.

Note that in the first embodiment, the first group of light sources and the second group of light sources may be parts of a light source array having 2K light sources arranged in a row from a first light source to a 2Kth light source. Meanwhile, of the 2K light sources, the first group of light sources includes the first to Kth light sources. Likewise, of the 2K light sources, the second group of light sources includes the K+1th to 2Kth light sources. Here, N=2K. K=4 in the example shown in FIG. 3.

The first embodiment describes a multiple exposure system that employs two current driving ICs, each of which is capable of driving four laser elements. However, the technical spirit of the present invention can also be applied in other driving ICs. A multi-channel analog-digital conversion IC, a PWM IC, or the like that handle multiple lasers can be given as examples of such other driving ICs. This is because the quantization performance of analog-digital conversion ICs is dependent on temperature, and the analog output performance of analog-digital conversion ICs is also dependent on temperature. Likewise, the light-emission timing performance of a PWM IC is dependent on temperature. Accordingly, the technical spirit of the present invention is useful as a way to reduce scanning unevenness resulting from such factors.

Figure 14:
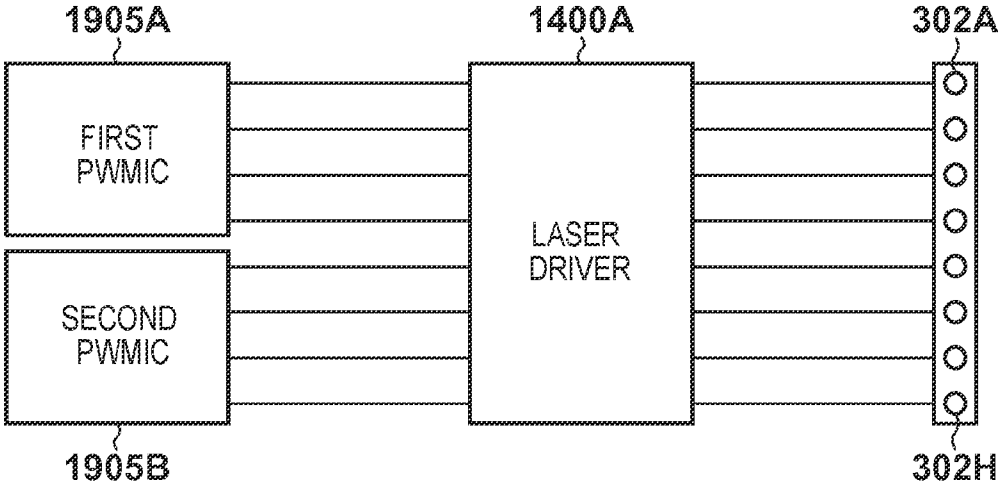
FIG. 14 is a diagram illustrating an example of connections between a driving IC and a light source array.

FIG. 14 illustrates a laser driver 1400A, serving as a driving IC capable of driving eight laser elements, and a first PWM IC 1905A and a second PWM IC 1905B, which are driving ICs that support four laser elements, according to a second embodiment. A light source array includes the eight laser elements 302A-302H. In other words, the first PWM IC 1905A supports the laser elements 302A-302D serving as the first group of light sources, and the second PWM IC 1905B supports the laser elements 302E-302H serving as the second group of light sources. The multiple exposure carried out by the first group of light sources and the second group of light sources is as described above. The first embodiment and the second embodiment are the same with respect to other points, and thus descriptions thereof will be omitted. The multiple exposure process is evenly distributed between the first PWM IC 1905A and the second PWM IC 1905B, and thus there is an extremely low temperature difference between the two. As a result, there is an extremely low difference in exposure positions, extremely low light power unevenness, and so on between the first group of light sources and the second group of light sources, and thus second embodiment can achieve the same effects as the first embodiment. Using the aforementioned algebra, in the second embodiment, N=8, L=4, Q=2, and M=2.

According to the technical spirit of the present invention, a feedback control system such as that described in the first embodiment also reduces control error unevenness due to the reduced temperature difference between the driving ICs. This reduces the frequency at which the APC needs to be executed. In other words, the interval at which the APC is executed can be lengthened. Furthermore, the requirements with respect to light power variation characteristics, which depend on the temperatures of the driving ICs, can also be lightened. This not only increases the freedom with which the optical scanning apparatus 104 can be designed, but also improves component yield, component prices, and so on.

In the case where feedback control is not applied to the PWM ICs as in the second embodiment, the component yield, component price, and the like can be further improved due to a reduction in the absolute precision with respect to the temperature.

Figure 15:
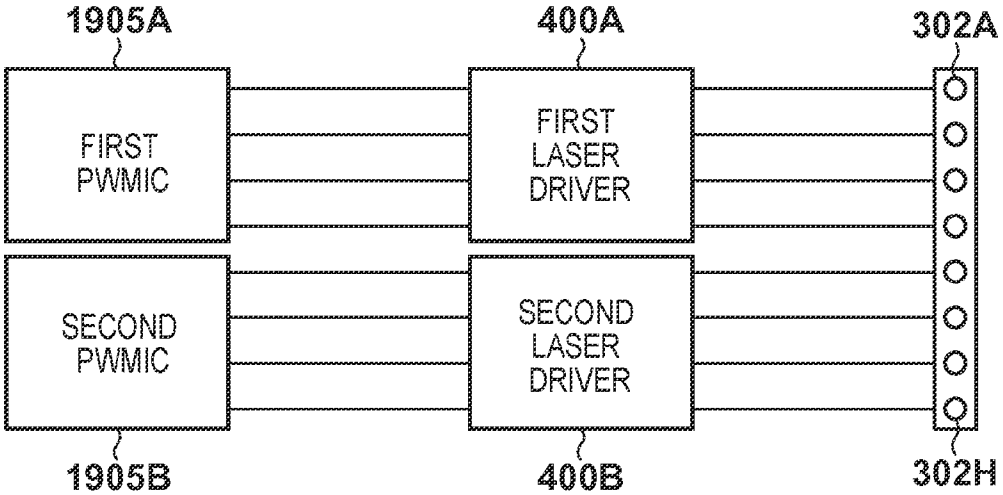
FIG. 15 is a diagram illustrating an example of connections between a driving IC and a light source array.

The technical spirit of the present invention can also be applied in a multiple exposure system such as that shown in FIG. 15. As shown in FIG. 15, the first PWM IC 1905A and the second PWM IC 1905B described in the second embodiment may be employed as PWM ICs. Likewise, the first laser driver 400A and the second laser driver 400B described in the first embodiment may be employed as laser drivers.

The present invention can be applied in such a multiple exposure system as well, and the same effects as in the first embodiment and the second embodiment can be achieved in such a case.

Although the foregoing embodiments describe examples of light source arrays having eight laser elements, the present invention can be applied with light source arrays having four laser elements, light source arrays having 32 laser elements, and so on. In other words, the present invention can be applied as long as the number of laser elements N that configure the light source array is a multiple of the number of driving ICs Q. This is because each driving IC will handle the driving of the same number of laser elements if the number of laser elements N is a multiple of Q.

Note that the total number of laser elements that can be supported by Q driving ICs need not be the same as the number of laser elements provided in the light source array. This is because each driving IC will handle the driving of the same number of laser elements.

Although the foregoing embodiments describe an example in which multiple exposure is executed twice for each pixel, the multiple exposure may be executed any number of times for each pixel as long as that number is a multiple of Q. In other words, the multiple exposure may be executed three times, four times, or the like. Three driving ICs are required for three instances of multiple exposure. Two or four driving ICs are required for four instances of multiple exposure. In either case, the number of instances of multiple exposure is a multiple of the number of driving ICs Q. Each driving IC will handle the driving of the same number of laser elements if the number of instances of multiple exposure is a multiple of Q.

Incidentally, in the image forming apparatus 100, a secondary scanning speed, a number of beams, and so on may change when switching from a given image forming mode to another image forming mode. This corresponds to, for example, a switch from a high-quality mode in which images are formed at 2,400 dpi to a standard quality mode in which images are formed at 1,200 dpi. In the case where eight laser elements are used to form images at 2,400 dpi, four laser elements may be used to form images at 1,200 dpi. In other words, of the eight laser elements 302A-302H, only the odd-numbered laser elements 302A, 302C, 302E, and 302G are used. In this case, the first laser driver 400A handles the driving of the laser elements 302A and 302C, while the second laser driver 400B handles the driving of the laser elements 302E and 302G. Each driving IC will thus handle the driving of the same number of laser elements. Meanwhile, the laser elements 302A and 302E carry out multiple exposure of the same pixels due to the same image data, and the laser elements 302C and 302G carry out multiple exposure of the same pixels due to the same image data. As such, each driving IC processes the same cumulative number of pixels, and the temperatures of the driving ICs repeatedly rise and fall in tandem.

Figure 16:
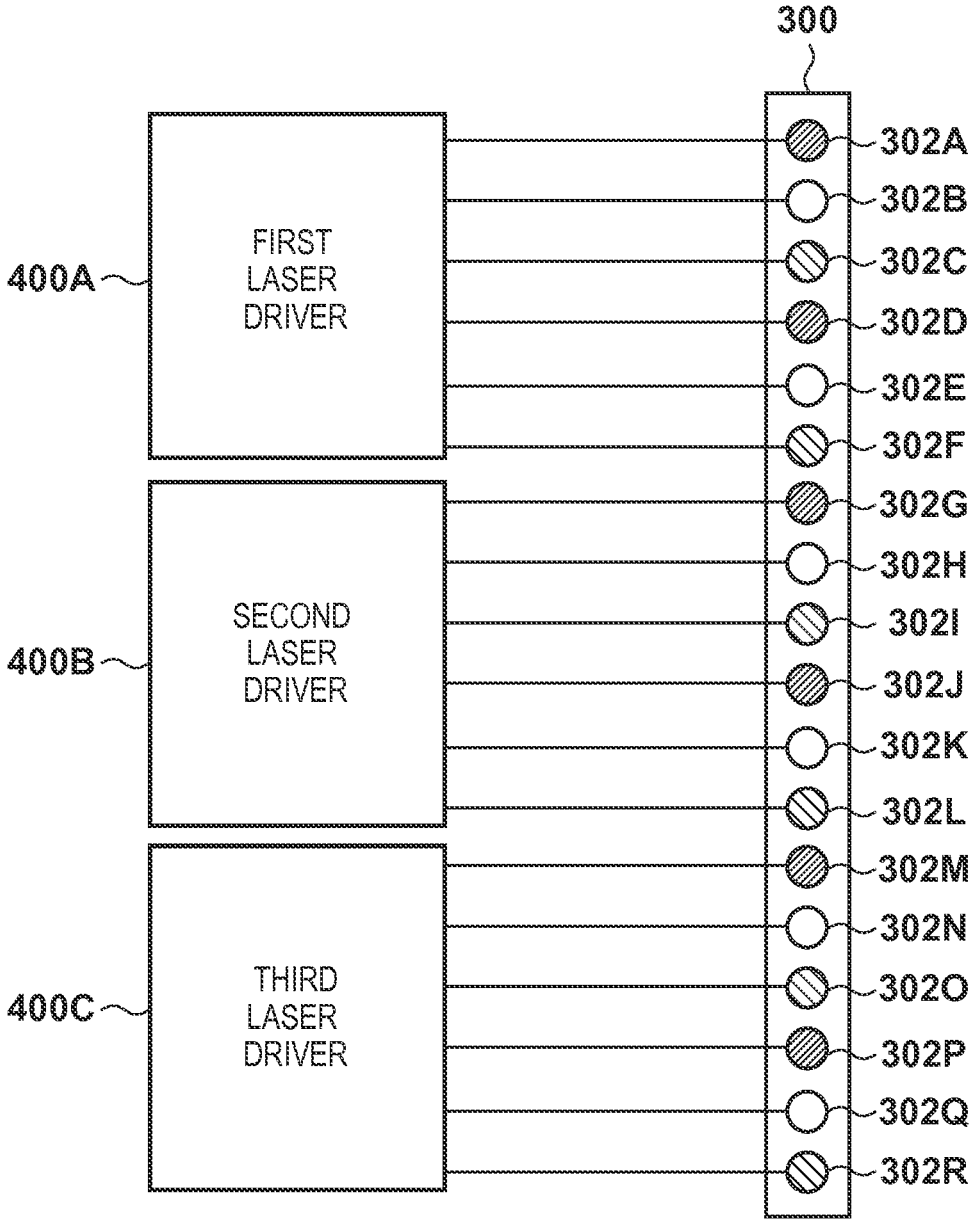
FIG. 16 is a diagram illustrating an example of connections between a driving IC and a light source array.

For example, as shown in FIG. 16, the optical scanning apparatus 104 may execute triple exposure using a light source array 300 having 18 laser elements 302A-302R. The optical scanning apparatus 104 may carry out the triple exposure at a first secondary scanning speed, and may carry out sextuple exposure at a second secondary scanning speed that is half the first secondary scanning speed. The rotational speed of the rotating polygonal mirror is the same for both the triple exposure and the sextuple exposure. Likewise, the primary scanning period (BD cycle) is the same for both the triple exposure and the sextuple exposure.

As shown in FIG. 16, the first laser driver 400A handles the driving of the laser elements 302A-302F. The second laser driver 400B handles the driving of the laser elements 302G-302L. A third laser driver 400C handles the driving of the laser elements 302M-302R.

In the sextuple exposure, the laser elements 302A, 302D, 302G, 302J, 302M, and 302P serve as a single group, and handle the exposure of the same primary scanning line. The laser elements 302B, 302E, 302H, 302K, 302N, and 302Q also serve as a single group, and handle the exposure of the same primary scanning line. Furthermore, the laser elements 302C, 302F, 302I, 302L, 302O, and 302R serve as a single group, and handle the exposure of the same primary scanning line.

Note that each laser driver may be capable of handling the driving of a maximum of eight laser elements. In other words, two of the eight driving circuits in each laser driver are extra driving circuits. Each laser driver runs the same number of driving circuits, and thus has the same number of extra driving circuits. Using the aforementioned algebra, in the present embodiment, N=18, L=8, Q=3, and M=6.

Because L laser elements can be driven by each of Q driving ICs, the total number of laser elements that can be driven is (L×Q); however, the number of laser elements N included in the light source array is no greater than (L×Q).

A plurality of laser element used for the multiple exposure of a single pixel are distributed evenly among the driving ICs. Accordingly, M is a multiple of Q. Note that M may also be 1×Q, or in other words, M may be equal to Q.

Although the aforementioned embodiments describe a VCSEL as an example of the light source array, the present invention can be applied even in an edge-emitting laser aside from a VCSEL. The present invention is not intended to be limited to the configurations described in the aforementioned embodiments, and can be applied in any configuration capable of realizing the functions disclosed in the appended claims or provided in the aforementioned embodiments. The image forming apparatus 100 may be a printing apparatus (a printer), a facsimile device having a printing function, a multifunction peripheral (MFP) having a printing function, a copying function, and a scanner function, or the like. The image forming apparatus 100 may be a monochromatic image forming apparatus or a multicolor image forming apparatus.

CONCLUSION

As described using FIG. 3 and the like, the first laser driver 400A functions as a first driving IC that drives the laser elements 302A-302D serving as a first group of light sources. The second laser driver 400B functions as a second driving IC that drives the laser elements 302E-302H serving as a second group of light sources. As described using FIG. 7, the second group of light sources executes a first exposure. The first group of light sources then executes a second exposure on the position exposed by the first exposure carried out by the second group of light sources. Multiple exposure is realized as a result. In other words, the optical scanning apparatus forms an electrostatic latent image on a photosensitive member by scanning the photosensitive member using laser beams emitted from the first group of light sources by the first driving IC and scanning the photosensitive member using laser beams emitted from the second group of light sources by the second driving IC. Note that the electrostatic latent image formed on the photosensitive member is developed by a developing unit using toner. More specifically, the CPU 961, the PWM IC 905, and so on that function as a data generating unit generate a first driving signal and a second driving signal based on input image data and output the first driving signal to the first driving IC and the second driving signal to the second driving IC. Note that the first driving signal and the second driving signal are generated based on image data of the same pixel contained in the input image data. The image forming apparatus is configured so that an exposure position of laser beams emitted from light sources due to the first driving signal generated based on the image data of the same pixel and an exposure position of laser beams emitted from light sources due to the second driving signal generated based on the image data of the same pixel overlap. In this manner, the multiple exposure process is distributed substantially evenly between the first driving IC and the second driving IC, which reduces a temperature difference between the first driving IC and the second driving IC and reduces scanning unevenness.

The multiple exposure need not be executed. However, the first driving IC controls the first group of light sources and the second driving IC controls the second group of light sources so that the first group of light sources and the second group of light sources expose the same pixels based on the same image data. Doing so reduces the temperature difference between the first driving IC and the second driving IC and reduces scanning unevenness.

The CPU 961 functions as a supply unit that supplies the same image data to the first driving IC and the second driving IC so that the temperature of the first driving IC and the temperature of the second driving IC rise and fall in tandem. As a result of supplying the same image data to the first driving IC and the second driving IC, the temperature of the first driving IC and the temperature of the second driving IC rise and fall in tandem. In other words, the temperature difference between the first driving IC and the second driving IC is reduced and scanning unevenness is reduced as well.

In the first embodiment, the first group of light sources and the second group of light sources are part of a light source array having 2K light sources arranged in a row from a first light source to a 2Kth light source. The first group of light sources has the laser elements 302A-302D, which are the first to Kth light sources, and the second group of light sources has the laser elements 302E-302H, which are the K+1th to 2Kth light sources of the 2K light sources. The first laser driver 400A drives the first to Kth light sources of the 2K light sources, and the second laser driver 400B drives the K+1th to 2Kth light sources of the 2K light sources. The CPU 961 supplies the same image data to the first driving IC and the second driving IC so that the temperature of the first driving IC and the temperature of the second driving IC rise and fall in tandem. Doing so reduces scanning unevenness.

As described using FIG. 7, the first to Kth light sources driven by the first laser driver 400A and the K+1th to 2Kth light sources driven by the second laser driver 400B correspond on a one-to-one basis. For example, the laser element 302A and the laser element 302E carry out multiple exposure of the same primary scanning line, and thus correspond one-to-one. The CPU 961 supplies the same image data to the first laser driver 400A and the second laser driver 400B so that two laser elements that correspond one-to-one carry out multiple exposure of the same primary scanning position. Doing so reduces a temperature difference between the first laser driver 400A and the second laser driver 400B and reduces scanning unevenness.

Furthermore, the aforementioned embodiments can be generalized as follows. The light source array may have N light sources, from a first light source to an Nth light source, arranged in a row. Q driving ICs may be configured to drive L light sources, where L is a number no greater than N/Q, of the N light sources (where N>Q). The supply unit supplies the same image data to each of the Q driving ICs. The temperatures of the Q driving ICs rise and fall in tandem, and thus scanning unevenness is reduced.

The same primary scanning position may undergo multiple exposure by a plurality of light sources driven by different driving ICs in the Q driving ICs. In the multiple exposure, the same data is used by each driving IC, and thus each driving IC experiences substantially the same change in temperature. This is advantageous for reducing the scanning unevenness.

If N is an integer of 4 or greater, it is easy to ensure that the laser drivers can serve as shared components for high-quality and mid-quality devices. This is because, for example, a laser array having four laser chips is used in a mid-quality device and a laser array having eight or 12 laser chips is used in a high-quality device.

The number of multiple exposures M may be equal to Q or a multiple of Q. In other words, in the case where Q driving ICs are used, the multiple exposure process can be distributed evenly among the Q driving ICs if the number of multiple exposures M is equal to Q or a multiple of Q. As a result, the temperature change is similar in each driving IC.

Each of the Q driving ICs drives M/Q light sources of the M light sources that scan the same primary scanning position. In FIG. 3, two laser elements scan the same primary scanning position, and thus the first laser driver 400A and the second laser driver 400B may drive one laser element apiece. Meanwhile, in the example shown in FIG. 16, six laser elements scan the same primary scanning position, and thus the first laser driver 400A, the second laser driver 400B, and the third laser driver 400C may drive two laser elements apiece. Note that N/Q is equal to K and M is equal to Q in both of these embodiments. FIG. 3 illustrates the specific case where M=2.

As described above, a laser driver IC that carries out current-based driving of a light source serves as an example of the driving IC. However, the driving IC may be any IC chip that contributes to the driving of the light source, and may be a PWM IC, for example, as described using FIG. 14. In other words, the driving IC may be a pulsewidth-modulating IC that pulsewidth-modulates a driving current for driving a light source.

Employing the optical scanning apparatus 104 as described above in the image forming apparatus 100 reduces scanning unevenness (exposure unevenness), and thus unevenness in the darkness of an image is reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-256443, filed Dec. 11, 2013, which is hereby incorporated by reference herein in its entirety.

What is claimed is:

1. An image forming apparatus comprising:

a photosensitive member;

an optical scanning apparatus including:

a semiconductor laser having a plurality of light sources each configured to emit laser beams for forming an electrostatic latent image on the photosensitive member, the plurality of light sources including at least first, second, third and fourth light sources, all included in the semiconductor laser, a first driving IC configured to drive the first light source and the second light source by supplying driving current thereto, a second driving IC configured to drive the third light source and the fourth light source by supplying driving current thereto, and a deflecting unit configured to deflect a plurality of the laser beams so that the laser beams emitted from the plurality of light sources scan the photosensitive member;

a signal generation unit configured to generate driving signals for the driving currents for driving the plurality of light sources, the driving signals being generated based on image data; and a developing unit configured to develop the electrostatic latent image formed on the photosensitive member using toner, wherein the light beam emitted from the third light source scans an area, on the photosensitive member, which the light beam emitted from the first light source has scanned and the light beam emitted from the fourth light source scans an area, on the photosensitive member, which the light beam emitted from the second light source has scanned, wherein the signal generation unit is further configured to generate a first driving signal for driving the first light source and a third driving signal for driving the third light source based on same image data corresponding to the first light source and the third light source, and to generate a second driving signal for driving the second light source and a fourth driving signal for driving the fourth light source based on same image data corresponding to the second light source and the fourth light source, wherein the first driving IC is further configured to supply a current to the first light source based on the first driving signal and supply a current to the second light source based on the second driving signal, and wherein the second driving IC is further configured to supply a current to the third light source based on the third driving signal and supply a current to the fourth light source based on the fourth driving signal.

2. The image forming apparatus according to claim 1, wherein the image forming apparatus is configured so that an exposure position of laser beam emitted from the first light source due to the first driving signal overlaps an exposure position of laser beam emitted from the third light source due to the third driving signal, and wherein an exposure position of laser beam emitted from the second light source due to the second driving signal overlaps an exposure position of laser beam emitted from the fourth light source due to the fourth driving signal.

3. The image forming apparatus according to claim 1, wherein, the first light source, the second light source, the third light source, and the fourth light source are arranged so that the laser beams emitted from the first light source and the second light source scan upstream, in a rotation direction of the photosensitive member, from the laser beams emitted from the third light source and the fourth light source, and a region exposed by the laser beams emitted from the first light source and the second light source in an nth scanning period is exposed by the laser beams emitted from the third light source and the fourth light source in an n+1th scanning period.

4. An image forming apparatus comprising:

a photosensitive member;

an optical scanning apparatus including:

a semiconductor laser having a plurality of light sources configured to emit laser beams for forming an electrostatic latent image on the photosensitive member, the plurality of light sources including at least a first N number of light sources and a second N number of different light sources, all included in the semiconductor laser, a first driving IC configured to drive the first N number of light sources by supplying driving current thereto, a second driving IC configured to drive the second N number of light sources by supplying driving current thereto, and a deflecting unit configured to deflect a plurality of the laser beams so that the laser beams emitted from the plurality of light sources scan the photosensitive member;

a signal generation unit configured to generate driving signals for the driving currents for driving the plurality of light sources, the driving signals being generated based on image data; and a developing unit configured to develop the electrostatic latent image formed on the photosensitive member using toner;

wherein the second N number of light sources driven by the second driving IC each respectively corresponds to a respective one of the first N number of light sources driven by the first driving IC, and each laser beam emitted from the second N number of light sources driven by the second driving IC scans on an area that is scanned by a laser beam emitted from corresponding one of the first N number of light sources driven by the first driving IC, wherein the signal generation unit is further configured to generate each driving signal to the first N number of light sources driven by the first driving IC and to the corresponding each one of the second N number of light sources driven by the second driving IC based on a same image data, and wherein the first driving IC and the second driving IC are further configured to supply driving currents to the first and second N number of light sources based on driving signals generated by the signal generation unit.

5. The image forming apparatus according to claim 4, wherein the first N number of light sources driven by the first driving IC and the second N number of light sources driven by the second driving IC are arranged so that the laser beams emitted from the first N number of light sources driven by the first driving IC scan upstream, in a rotation direction of the photosensitive member, from the laser beams emitted from the second N number of light sources driven by the second driving IC, and a region exposed by the laser beams emitted from the first N number of light sources driven by the first driving IC in an nth scanning period is exposed by the laser beams emitted from the second N number of light sources driven by the second driving IC in an n+1th scanning period.

* * * * *